US007570145B2

(12) United States Patent
Yeh et al.

(10) Patent No.: US 7,570,145 B2
(45) Date of Patent: Aug. 4, 2009

(54) SOFT MAGNETISM THIN FILM INDUCTOR AND MAGNETIC MULTI-ELEMENT ALLOY FILM

(75) Inventors: Jien-Wei Yeh, Hsinchu (TW); Wen-Chen Chang, Hsinchu (TW); Chih-Chao Yang, Hsinchu (TW); Nai-Wen Cheng, Tainan (TW)

(73) Assignee: Industrial Technology Research Institute, Hsinchu (TW)

( * ) Notice: Subject to any disclaimer, the term of this patent is extended or adjusted under 35 U.S.C. 154(b) by 21 days.

(21) Appl. No.: 11/933,389

(22) Filed: Oct. 31, 2007

(65) Prior Publication Data

US 2008/0150663 A1 Jun. 26, 2008

(30) Foreign Application Priority Data

Dec. 22, 2006 (TW) ..... 95148391 A

(51) Int. Cl.
*H01F 27/24* (2006.01)

(52) U.S. Cl. ..... 336/233

(58) Field of Classification Search ..... 336/65, 336/83, 200, 206–208, 232–233; 428/812, 428/836.3

See application file for complete search history.

(56) References Cited

U.S. PATENT DOCUMENTS

| | | | | |
|---|---|---|---|---|
| 4,921,763 | A * | 5/1990 | Karamon | 428/836.3 |
| 5,750,273 | A * | 5/1998 | Inoue et al. | 428/836.3 |
| 5,780,177 | A * | 7/1998 | Tomita et al. | 428/812 |
| 6,140,902 | A * | 10/2000 | Yamasawa et al. | 336/83 |
| 6,404,317 | B1 * | 6/2002 | Mizoguchi et al. | 336/200 |
| 6,768,409 | B2 * | 7/2004 | Inoue et al. | 336/200 |

* cited by examiner

*Primary Examiner*—Tuyen T. Nguyen
(74) *Attorney, Agent, or Firm*—Jianq Chyun IP Office

(57) ABSTRACT

A magnetic multi-element alloy film adapted to be used in a high-frequency operation is provided. The magnetic multi-element alloy film is employed to improve a Q factor and an inductance value of a thin film inductor operated in high frequency. The design concept of a multi-element high-entropy alloy is introduced into the magnetic multi-element alloy film. With material characteristics including high randomness, nanometer microcrystalline structure, low coercive magnetic field and high resistivity, the magnetic multi-element alloy film can still have favorable soft magnetism when operated in high frequency.

23 Claims, 7 Drawing Sheets

SOFT MAGNETISM THIN FILM INDUCTOR AND MAGNETIC MULTI-ELEMENT ALLOY FILM

CROSS-REFERENCE TO RELATED APPLICATION

This application claims the priority benefit of Taiwan application serial no. 95148391, filed on Dec. 22, 2006. All disclosure of the Taiwan application is incorporated herein by reference.

BACKGROUND OF THE INVENTION

1. Field of the Invention

The present invention relates to a soft magnetism thin film inductor and a magnetic multi-element alloy film.

2. Description of Related Art

With rapid progress in information technology (IT) industry, a soft magnetism thin film is extensively applied to a RF-band, particularly in a range between 800 MHz and 6 GHz. For example, the soft magnetism thin film may be applied to an integrated passive device, an electromagnetic noise protection measure, a sensor, and so on. Specifically, in terms of wireless communication applications, an operating frequency of a wireless local area network (WLAN) system has attained to a GHz-band, so as to deal with mass data transmission, such as Bluetooth and IEEE802.11b in a 2.45 GHz frequency band, IEEE802.11a in a 5.8 GHz frequency band, and so forth.

On the other hand, in order to enhance portability of mobile communication devices and to integrate multiple functions thereof, miniaturization of mobile phone components is one of the focuses in relevant research and development. Thus, the size of indispensable passive devices including thin film inductors and multilayer capacitors in the electronic devices is reduced little by little. Here, the fabrication of the thin film inductors has called for significant attention.

Nowadays, a high-frequency inductor is mainly fabricated with use of ferrite powder (ceramic ferromagnetic materials), so as to avoid generation of eddy currents when the inductor is operated in high frequency. In the manufacturing process, the ferrite powder is first sintered at a high temperature and then bonded to a circuit board through performing a surface mounting technology (SMT). The most advantageous feature of the ceramic ferromagnetic material lies in its high resistivity, whereas other characteristics possessed by the ceramic ferromagnetic material are not beneficial for high-frequency communication applications. For example, saturation magnetization of the ceramic ferromagnetic material is lower than that of a metallic ferromagnetic material, and thus a restriction of Snoek's limit may be imposed on the ceramic ferromagnetic material in a high-frequency operation. A magnetic permeability value of the ceramic ferromagnetic material is less than 5 GHz. Moreover, since a maximum temperature at which a Si integrated circuit is manufactured is 500° C., integration of ferrite passive devices to a single chip is also demanding.

On the other hand, the inductor may also be fabricated by utilizing a conventional permalloy thin film. In spite of great saturation magnetization, the relatively low resistivity of the permalloy thin film results in significant loss of the eddy currents in the high-frequency operation, bringing about non-occurrence of magnetic effects. To achieve favorable magnetic permeability in the high-frequency operation, new soft magnetism alloys including FeTaN, FeBSi, CoNbZr and FeAlO have been launched recently. However, several issues associated with the soft magnetism alloys are to be resolved. For example, since a FeTaN thin film and a CoNbZr thin film have excessively low magnetic anisotropy fields, as the frequencies thereof are less then 100 MHz, the values of the magnetic permeability are rapidly decreased. Further, a FeBSi thin film may still have iron loss in the high-frequency operation due to its relatively low resistance value (approximately 150 μΩ-cm) reducing induction efficiency. With respect to researches on improvement of the high-frequency characteristics possessed by the thin film inductor, variations in a magnetic flux generated when currents pass through conductors are amplified by extensively adopting magnetic materials. Thereby, inductance and a quality factor (Q factor) can be improved. For example, in U.S. Pat. No. 3,413,716, it is proposed to form a ferrite layer on a conductive layer of the thin film inductor through a physical deposition performed on the thin films, such that the Q factor of the thin film inductor can be enhanced. However, as the frequency exceeds 100 MHz, the magnetic permeability is expeditiously reduced, and therefore it is unlikely for the thin film inductor device to improve inductance and the Q factor by means of magnetic amplification in the high-frequency operation.

Besides, in the researches on adding the magnetic materials during the process of making the thin film inductor, the high-frequency characteristics of the thin film inductor may also be improved through a structural design thereof. For example, in U.S. Pat. No. 6,373,369 B2, a cylindrical magnetic material located at the center of a spiral conductor is disclosed, and the cylindrical magnetic material is not in contact with the spiral conductor for improving the high-frequency characteristics possessed by the thin film inductor. Nevertheless, the complicated shapes of the thin film inductor and the intricate manufacturing process thereof raise the costs of fabricating the magnetic material. On the other hand, in U.S. Pat. No. 6,822,548 B2, the magnetic material encasing coils of the thin film inductor is not arranged in sequence. Air gaps formed in the magnetic material divide the same into sections, so as to prevent loss of the eddy currents in the high-frequency operation. However, in the thin film inductor, the magnetic material does not completely cover the conductive layer, and thus an improvement of inductance per unit area is restricted. The requirement for complicated shapes also results in higher manufacturing costs of the magnetic material.

Furthermore, Japanese Patent No. 5,101,930 provides a highly saturated magnetic flux layer and a soft magnetism layer which are alternately stacked, e.g. a multi-layered film having stacked FeBN/FeN. The multi-layered structure is capable of efficiently enhancing saturation magnetization, while the resistance value is still insufficient. Accordingly, loss of the eddy currents leads to a rapid decrease in the Q factor, such that the multi-layered structure is unlikely to be applied in the high-frequency operation.

SUMMARY OF THE INVENTION

In view of the foregoing, the present invention is directed to a soft magnetism thin film inductor and a magnetic multi-element alloy film which can be both integrated into a standard VLSI manufacturing process and serve as a high-frequency soft magnetism thin film inductor. Besides, an inductance value and a Q factor thereof are better than those of an air core inductor.

The present invention is further directed to a soft magnetism thin film inductor and a magnetic multi-element alloy film characterized by high randomness, nanometer microcrystalline structure, low coercive magnetic field and high resistivity, such that the magnetic multi-element alloy film has favorable soft magnetism when operated in high frequency.

The present invention provides a soft magnetism thin film inductor including a first dielectric layer, a spiral conductive layer, a second dielectric layer and a magnetic multi-element alloy film. The spiral conductive layer is disposed on the first dielectric layer. A starting point of the spiral conductive layer is in a center of the spiral, whereas a destination point of the spiral conductive layer is in outermost peripheral areas of the spiral. The second dielectric layer is disposed on the spiral conductive layer. The magnetic multi-element alloy film is disposed on the second dielectric layer, and is composed of 3~13 types of elements.

The present invention further provides a magnetic multi-element alloy film. A general formula of a composition of the magnetic multi-element alloy film is AX. A is selected from one or more groups consisting of ferrum (Fe), cobalt (Co) and nickel (Ni). X is selected from one or more groups consisting of hafnium (Hf), silicon (Si), boron (B), copper (Cu), aluminum (Al), tantalum (Ta), niobium (Nb), chromium (Cr), stannum (Sn), zirconium (Zr), titanium (Ti), palladium (Pd), aurmm (Au), platinum (Pt), silver (Ag), ruthenium (Ru), molybdenum (Mo), vanadium (V) and manganese (Mn). A accounts for 70~90 atom percent (at. %) of all atomic elements, and AX is composed of 3-13 elements.

The magnetic multi-element alloy film of the present invention is characterized by high randomness, nanometer microcrystalline structure, low coercive magnetic field and high resistivity. Thus, the magnetic multi-element alloy film has favorable soft magnetism when operated in high frequency. Moreover, since the magnetic multi-element alloy film can be formed by performing a sputtering process, the fabrication of the magnetic multi-element alloy film can be integrated into the standard VLSI manufacturing process.

In addition, the soft magnetism thin film inductor of the present invention has a greater inductance value and a better Q factor than the air core inductor does when operated in high frequency, and the manufacturing process of the soft magnetism thin film inductor according to the present invention is rather simple, reducing time and manufacturing costs.

In order to the make the aforementioned and other objects, features and advantages of the present invention comprehensible, several embodiments accompanied with figures are described in detail below.

DESCRIPTION OF EMBODIMENTS

Figure 1:
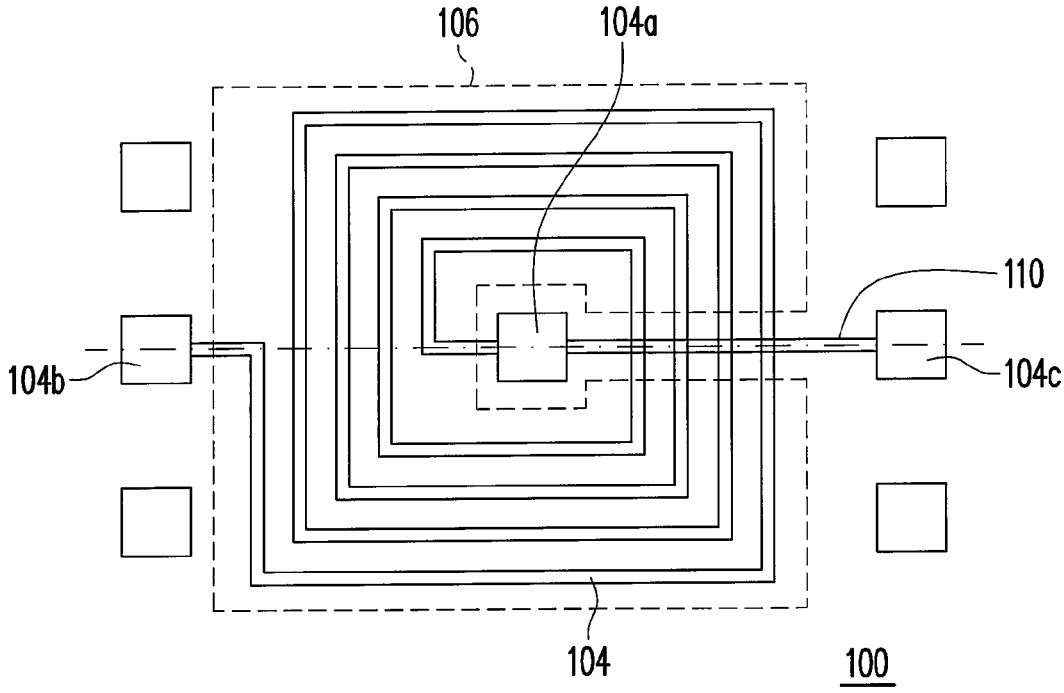
FIG. 1 is a top view of a soft magnetism thin film inductor according to an embodiment of the present invention.

In the present invention, a design concept of a multi-element high-entropy alloy is introduced and applied to develop a magnetic multi-element alloy film material having great magnetic permeability when the magnetic multi-element alloy film material is operated in high frequency. The magnetic multi-element alloy film is characterized by high saturation magnetization, low coercive magnetic field, high resistivity, and so forth. The so-called multi-element high-entropy alloy of the present invention refers to the alloy composed of 3~13 types of elements, and variations of each molar entropy ($\triangle S$) satisfy the following formula (1):

$$1.10R \leqq \triangle S \leqq 2.57R(J/K\ \text{mole}) \quad (1)$$

Here, R is a gas constant (8.314 J/K mole).

A general formula of a composition of the magnetic multi-element alloy film according to the present invention is AX. A is, for example, selected from one or more groups consisting of Fe, Co and Ni. X is, for example, selected from one or more groups consisting of Hf, Si, B, Cu, Al, Ta, Nb, Cr, Sn, Zr, Ti, Pd, Au, Pt, Ag, Ru, Mo, V and Mn. Besides, AX is composed of 3~13 types of elements. A accounts for 70~90 at. % of all atomic elements.

In the magnetic multi-element alloy film of the present invention, A is Fe and Co, and X is B and M. M is selected from one or more groups consisting of Hf, Si, Cu, Al, Ta, Nb, Cr, Sn, Zr, Ti, Pd, Au, Pt, Ag, Ru, Mo, V and Mn, and M accounts for 1~9 at. % of all the atomic elements. Preferably, M is selected from one or more groups consisting of Hf, Ta, Nb, Ti and V, In particular, Nb and Ti are more desirable.

In the magnetic multi-element alloy film of the present invention, A is Fe and Co, and X is B and M. M is selected from one of the groups consisting of Hf, Ta, Nb, Ti and V, and M accounts for 1~9 at. % of all the atomic elements.

In the magnetic multi-element alloy film of the present invention, A is Fe, Co and Ni, and X is either B and Al or Si, Al and Cr.

In the composition of the magnetic multi-element alloy film, A accounts for 70~90 at. % of all the atomic elements. The minimum value at 70 at. % is determined to obtain better saturation magnetization Ms which generally conforms to a principle of dilution. On the other hand, the maximum value at 90 at. % is decided, so as to obtain sufficient alloy elements for promoting nanocrystallization and amorphization and for increasing the resistivity in consideration of atomic size and lattice distortion. Additionally, a thickness of the magnetic multi-element alloy film ranges from 50 nm to 2000 nm.

In the magnetic multi-element alloy film of the present invention, a thin film resistivity is larger than or equal to 200 μΩ-cm, coercive magnetic fields in an easy-axis and in a hard-axis are both less than or equal to 100 Oe, a magnetic anisotropy field intensity is larger than or equal to 20 Oe, and saturation magnetization is larger than or equal to 1.1 T. Conventionally, a device fabricated with use of the multi-element alloy film cannot achieve a high-frequency band on the conditions that the thin film resistivity of the multi-element alloy film is less than 200 μΩ-cm, the coercive magnetic fields in the easy-axis and in the hard-axis exceed 100 Oe, and the magnetic anisotropy field intensity is less than 20 Oe, Accordingly, the magnetic multi-element alloy film of the present invention can still possess favorable soft magnetism when operated in high frequency.

The magnetic multi-element alloy film of the present invention is basically composed of three magnetic elements Fe, Co and Ni. Through doping multiple elements, the alloy is characterized by high randomness, nanometer microcrystalline structure, low coercive magnetic field and high resistivity. Thereby, a soft magnetism thin film material having great magnetic permeability can be formed even though the soft magnetism thin film is operated in high frequency. Besides, the magnetic multi-element alloy film can be fabricated through performing a sputtering process, and thus the fabrication of the magnetic multi-element alloy film can be integrated into a standard VLSI manufacturing process.

Figure 2:
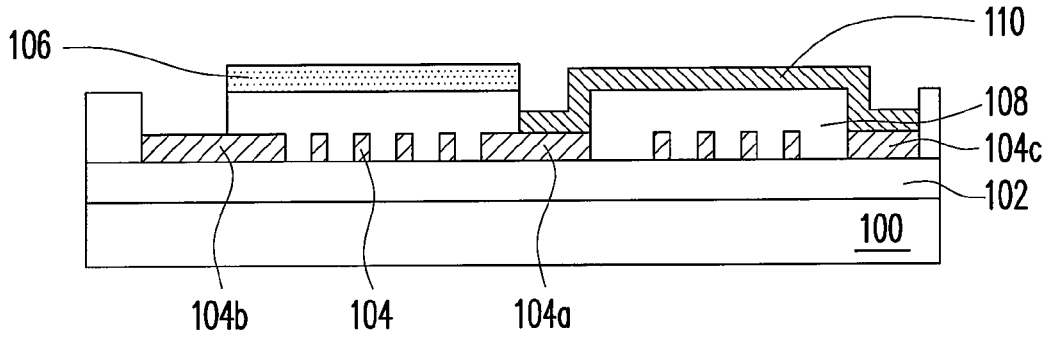
FIG. 2 is a cross-sectional view of the soft magnetism thin film inductor taken along line A-A' of FIG. 1.

A soft magnetism thin film inductor of the present invention is then described hereinafter. FIG. 1 is a top view of the soft magnetism thin film inductor according to an embodiment of the present invention. FIG. 2 is a cross-sectional view of the soft magnetism thin film inductor taken along line A-A' of FIG. 1.

Referring to FIGS. 1 and 2, the soft magnetism thin film inductor of the present invention includes a substrate 100, a first dielectric layer 102, a spiral conductive layer 104, a second dielectric layer 108 and a magnetic multi-element alloy film 106, for example.

The substrate 100 is, for example, a silicon wafer, and the substrate 100 is also likely to be a plastic substrate, a glass substrate, and so on.

The first dielectric layer 102 is disposed on the substrate 100, and a material of the first dielectric layer 102 is, for example, oxide, nitride or fluoride.

The spiral conductive layer 104 is disposed on the first dielectric layer 100. A starting point 104*a* of the spiral conductive layer 104 is in a center of the spiral, and a destination point 104*b* of the spiral conductive layer 104 is in outermost peripheral areas of the spiral. The spiral conductive layer 104 is made of aluminum or copper, for example.

The second dielectric layer 108 is disposed on the spiral conductive layer 104 and fills spaces among the spiral conductive layer 104. For example, the second dielectric layer 108 exposes the starting point 104*a* and the destination point 104*b* of the spiral conductive layer 104, and a conductive contact 104*c* used to connect the destination point 104*b* of the spiral conductive layer 104. A material of the second dielectric layer 108 is, for example, oxide, nitride or fluoride.

The magnetic multi-element alloy film 106 is disposed on the second dielectric layer 108 and above the spiral conductive layer 104. Besides, the magnetic multi-element alloy film 106 at least exposes the starting point 104*a* and the destination point 104*b* of the spiral conductive layer 104. A material of the magnetic multi-element alloy film 106 is, for example, the multi-element high-entropy alloy. The magnetic multi-element alloy film 106 is composed of 3~13 types of the elements, and the variations of each molar entropy ($\triangle S$) satisfies the following formula (1):

$$1.10R \leqq \triangle S \leqq 2.57R(J/K\ \text{mole}) \quad (1)$$

Here, R is a gas constant (8.314 J/K mole).

With the disposition of the magnetic multi-element alloy film 106 characterized by high randomness, nanometer microcrystalline structure, low coercive magnetic field and high resistivity, the soft magnetism thin film inductor of the present invention can be operated in high frequency.

A method of fabricating the soft magnetism thin film inductor of the present invention is described hereinafter. FIGS. 3A to 3G are cross-sectional flowcharts illustrating a process of manufacturing the soft magnetism thin film inductor according to an embodiment of the present invention.

Figure 3A:
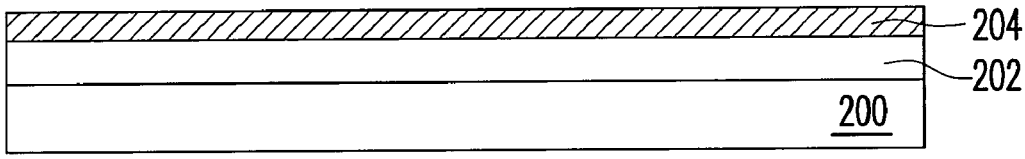
FIGS. 3A to 3G are cross-sectional flowcharts illustrating a process of manufacturing a soft magnetism thin film inductor according to an embodiment of the present invention.

Referring to FIG. 3A, a substrate 200 is provided. The substrate 200 is, for example, a silicon wafer. Thereafter, a first dielectric layer 202 is formed on the substrate 200. A material of the first dielectric layer 202 is, for example, silicon oxide, and the first dielectric layer 202 is formed, for example, by a thermal oxidation. In addition, to reduce loss of eddy currents due to a high-frequency operation of the substrate 200 and parasitic capacitance arisen from a capacitor formed by the substrate and a subsequently-fabricated metal layer, a thickness of the first dielectric layer 202 is approximately 1 micrometer, preferably. Next, a conductive layer 204 is formed on the first dielectric layer 202. A material of the conductive layer 204 is aluminum, for example, and the conductive layer is formed by evaporation, for example. A thickness of the conductive layer 204 is 500 nm, for example.

Figure 3B:
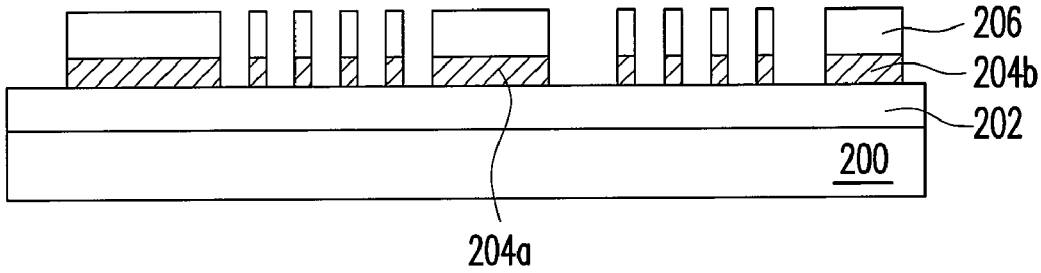
Figure 3C:
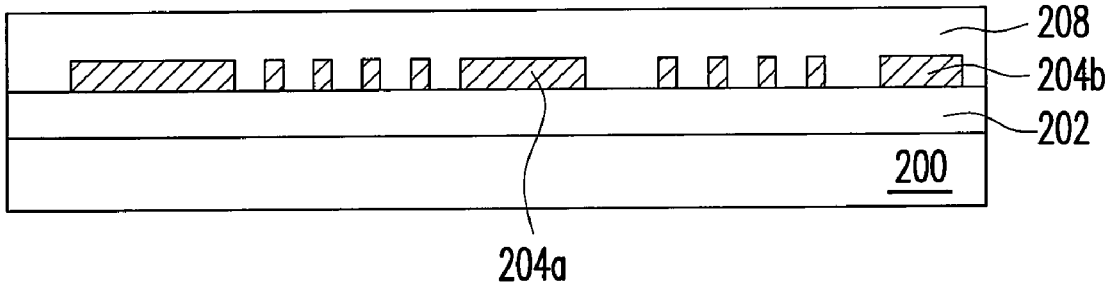

Referring to FIG. 3B, a patterned photoresist layer 206 is formed on the conductive layer 204. The patterned photoresist layer 206 is formed by performing a photolithography process, for example. Thereafter, a portion of the conductive layer 204 is removed with use of the patterned photoresist layer 206 as a mask, and a spiral conductive layer 204*a* and a conductive contact 204*b* are formed. The portion of the conductive layer 204 is removed by performing a wet etching process, for example, and an etchant solution is basically composed of phosphoric acid. With reference to FIG. 3C, the patterned photoresist layer 206 is then removed. A solvent used to remove the patterned photoresist layer 206 is, for example, acetone. After that, a second dielectric layer 208 is formed on the substrate 200. A material of the second dielectric layer 208 includes but is not limited to silicon oxide, and the second dielectric layer 208 is formed by performing a plasma enhanced chemical vapor deposition (PECVD) process, for example. The second dielectric layer 208 serves as an isolating layer between the spiral conductive layer 204*a* and a subsequently-formed magnetic thin film.

Figure 3D:
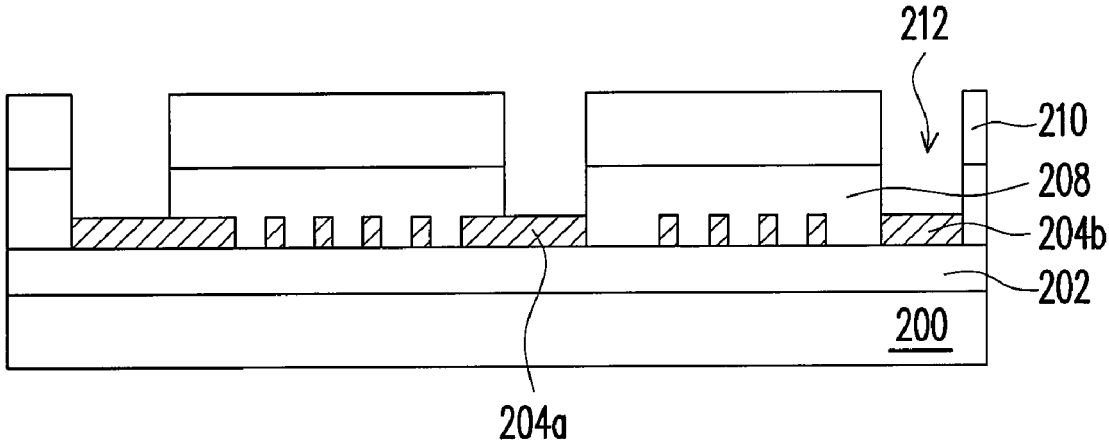

Referring to FIG. 3D, a patterned photoresist layer 210 is formed on the second dielectric layer 208. The patterned photoresist layer 210 is formed by performing the photolithography process, for example. After that, a portion of the second dielectric layer 208 is removed with use of the patterned photoresist layer 210 as a mask, and a plurality of via openings 212 is formed on the second dielectric layer 208. The via openings 212 expose a starting point and a destination point of the spiral conductive layer 204*a*, and the conductive contact 204*b*, respectively. The portion of the second dielectric layer 208 is removed by performing the wet etching process, for example, and the etchant solution is a buffered oxide etchant (BOE), for example. Additionally, in order to avoid the conductive layer below silicon oxide from being damaged because of using the BOE, a two-step etching may be performed as well. For example, a part of silicon oxide is firstly etched with use of the BOE, and the remained silicon oxide is removed by implementing a reactive ion etching process. The via openings 212 are used to connect the spiral conductive layer 204*a* with the outside world.

Figure 3E:
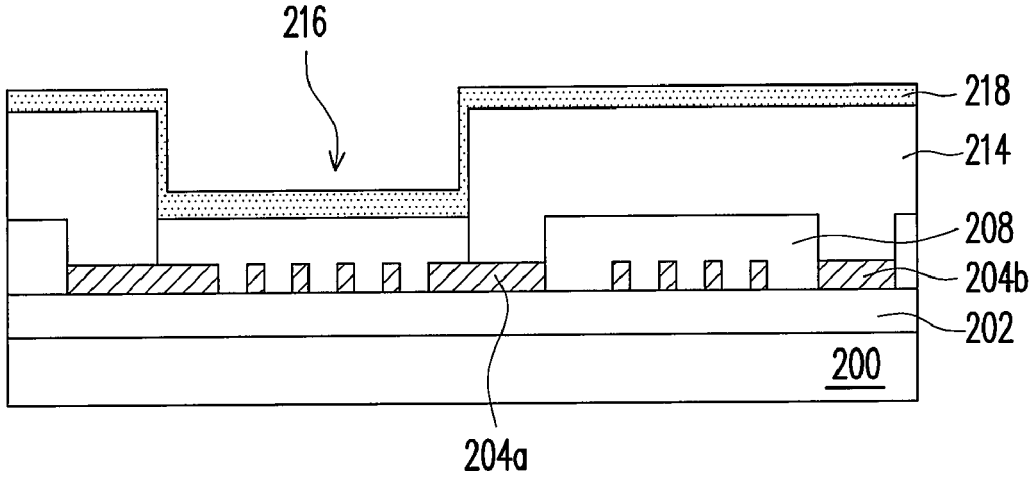

Referring to FIG. 3E, the patterned photoresist layer 210 is removed. The solvent used to remove the patterned photoresist layer 210 is, for example, acetone. Afterwards, a patterned photoresist layer 214 is formed on the second dielectric layer 208. The patterned photoresist layer 214 is formed by performing the photolithography process, for example, and the patterned photoresist layer 214 has an opening 216 exposing an area in which a magnetic thin film layer is to be formed. Next, a magnetic multi-element alloy film 218 is formed on the substrate 200. The magnetic multi-element alloy film 218 is formed by performing a sputtering process, for example. A target employed in the sputtering process is formed by placing a prepared metal mixture (including three or more metallic elements) on a water-cooling copper mold at first. After extracting 10-2 torr of gas out of a vacuum environment, 50 torr of pure argon is introduced. The extracting process and the introducing process are repeated for four times, and a melting process is then performed, so as to avoid excessive oxidation when the alloy is melted. A melting current is 300 amperes. As each melting process is carried out, the solidified alloy in the copper mold is flipped over for implementing the next melting process. After the melting process has been repetitively performed for five times or more, all the alloy elements are melted and well-mixed. Next, the alloy is melted in a plate-shaped copper mold having a 2-inch diameter, so as to obtain a plate-shaped ingot having the 2-inch diameter. The melting current is 500 amperes. After the flipping process and the melting process have been repetitively implemented for five times or more, a multi-element alloy target for sputtering can be obtained. Afterwards, to induce magnetic anisotropy of the magnetic multi-element alloy film 218, an in-plate field annealing treatment is performed on an as-deposited thin film. During the field annealing treatment, a direction of an applied magnetic field is parallel to a surface of the thin film, a background pressure thereof is $10^{-6}$ torr, and an intensity of the applied magnetic field is in a range of 500 Oe~1500 Oe. An annealing temperature ranges from 100° C. to 500° C., for example, and an annealing time is 0.5 hr~1.5 hr, for example. After the field annealing treatment is performed, the thin film resistivity is equal to or larger than 200 μΩ-cm, and the magnetic anisotropy field intensity is equal to or larger than 20 Oe.

Figure 3F:
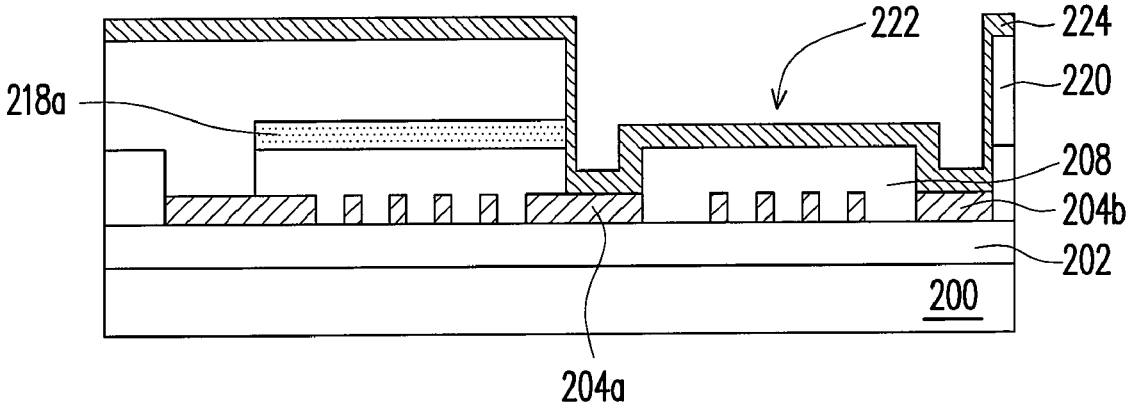
Figure 3G:
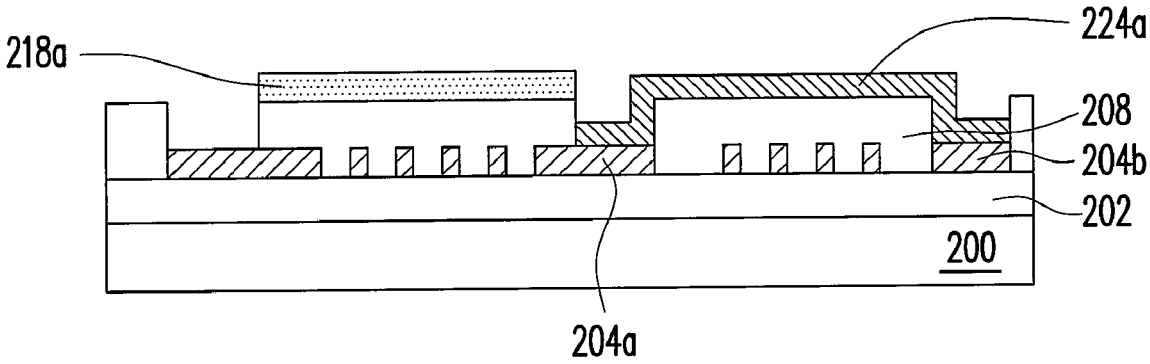

Referring to FIG. 3F, a lift-off process is implemented to peel off the magnetic multi-element alloy film 218 on the patterned photoresist layer 214, such that a magnetic multi-element alloy film 218*a* is formed. Simultaneously, the patterned photoresist layer 214 is removed. Thereafter, a patterned photoresist layer 220 is formed on the substrate 200. The patterned photoresist layer 220 is formed by performing the photolithography process, for example. The patterned photoresist layer 220 has an opening 222 exposing the starting point 204*a* of the spiral conductive layer 204*a* and the conductive contact 204*b*. Then, a conductive layer 224 is formed on the substrate 200. The conductive layer 224 is electrically connected to the starting point of the spiral conductive layer 204*a* and the conductive contact 204*b*. A material of the conductive layer 224 is aluminum, for example, and the conductive layer 224 is formed by evaporation, for example. With reference to FIG. 3G, the lift-off process is adopted to peel off the conductive layer 224 on the patterned photoresist layer 220, such that a conductive layer 224*a* is formed. Simultaneously, the patterned photoresist layer 220 is removed. The subsequent process of manufacturing the soft magnetism thin film inductor is well known to those skilled in the art, and thus no further description is provided herein.

Since the magnetic multi-element alloy film 218 can be formed on the substrate 200 by performing the sputtering process, the fabrication of the soft magnetism thin film inductor of the present invention can be integrated into the standard VLSI manufacturing process. As such, the manufacturing process is simplified, and the time and the manufacturing costs are reduced as well.

The following experimental examples are presented to demonstrate effects achieved by the soft magnetism thin film inductor and the magnetic multi-element alloy film of the present invention.

EXPERIMENTAL EXAMPLE 1

The Soft Magnetism Thin Film Inductor Using a FeCoNiAlB Thin Film

Five alloy elements Fe, Co, Ni, Al and B are selected and melted into an alloy target. A composition of the alloy target is $Fe_{42}Co_{37}Ni_{10}Al_5B_6$, a saturated magnetic flux density thereof is 1.66 T, and a coercive magnetic field is 18 Oe.

The FeCoNiAlB thin film is used to fabricate a ferromagnetic thin film inductor according to the above-mentioned manufacturing method of the soft magnetism thin film inductor. The conditions of manufacturing the FeCoNiAlB thin film includes an operating pressure at 5 mtorr, a gas flow rate in 18 sccm, a background pressure less than $9*10^{-6}$ torr, a fixed operating distance at 5 cm, a substrate made of silicon oxide (200 nm)/n-type Si (100), a 30-minute sputtering time, and a sputtering power at 53 w. On said conditions, an RF magnetron sputtering process is performed. Afterwards, in order to induce magnetic anisotropy of the magnetic film, an in-plane field annealing treatment is performed on an as-deposited thin film. During the field annealing treatment, a direction of an applied magnetic field is parallel to a surface of the thin film, the background pressure is at $10^{-6}$ torr, and an intensity of the applied magnetic field is 1000 Oe. The annealing process is, for example, performed at 300° C. for an hour, saturation magnetization thereof is 1000 emu/cm$^3$, the coercive magnetic field in the hard-axis is 5 Oe, the magnetic anisotropy field intensity is about 25 Oe, and the thin film resistivity is 420 μΩ-cm. A thickness of the ferromagnetic. thin film is 200 nm, a dimension of the inductor is 508*508 μm2, a line width is 13 μm, and a linear distance is 20 μm. Besides, the ferromagnetic thin film has a winding of 4 turns.

Figure 4:
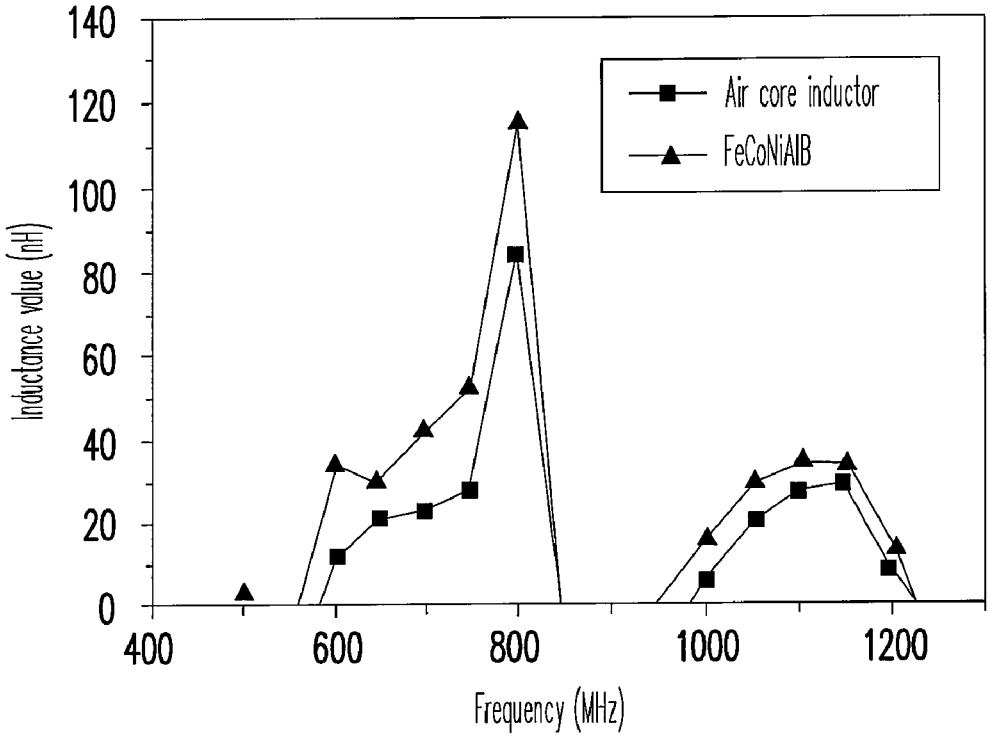
FIG. 4 is a diagram illustrating a comparison of an inductance value of a FeCoNiAlB soft magnetism thin film inductor with a frequency thereof.
Figure 5:
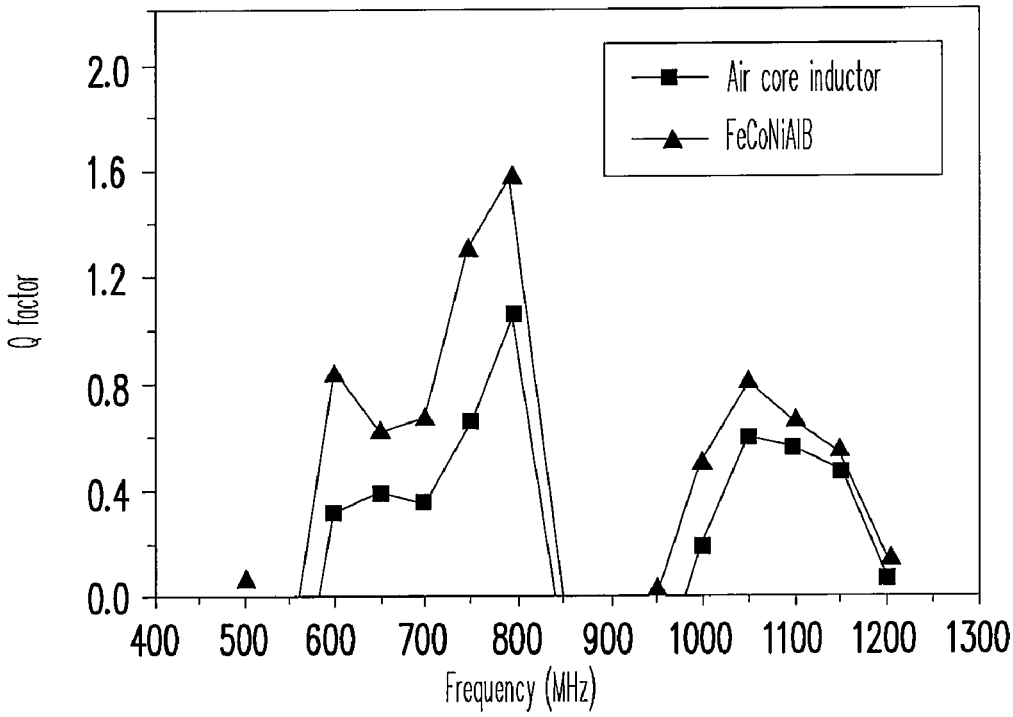
FIG. 5 is a diagram illustrating a comparison of a Q value of a FeCoNiAlB soft magnetism thin film inductor with a frequency thereof.

Thereafter, an HP8510C network analyzer is adopted to measure a high-frequency electrical property of the ferromagnetic thin film inductor. FIGS. 4 and 5 represent an inductance value and a Q value measured by the HP8510C network analyzer. As shown in FIGS. 4 and 5, in a 800 MHz frequency band, the inductance value of the ferromagnetic thin film inductor using the FeCoNiAlB thin film is increased by 32% than in comparison with the air core inductor, and the Q value of the ferromagnetic thin film inductor using the FeCoNiAlB thin film is increased by 47%. In other words, the inductor fabricated by using the magnetic multi-element alloy film of the present invention indeed improves the inductance value and the Q value per unit surface area of the inductor.

EXPERIMENTAL EXAMPLE 2

Six alloy elements Fe, Co, Ni, Al, Cl and Si are selected and melted into the alloy target. The composition of the alloy target is $Fe_{40}Co_{35}Ni_5Al_5Cr_5Si_{10}$, the saturated magnetic flux density thereof is 1.18 T, and the coercive magnetic field is 8 Oe.

Figure 6:
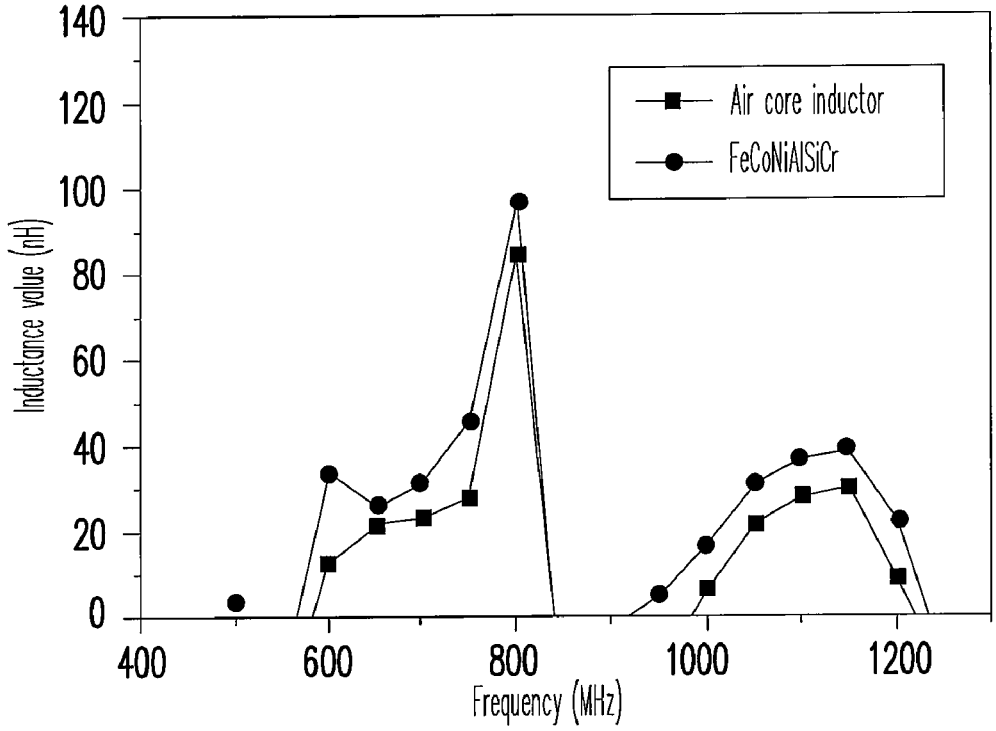
FIG. 6 is a diagram illustrating a comparison of an inductance value of a FeCoNiAlCrSi soft magnetism thin film inductor with a frequency thereof.
Figure 7:
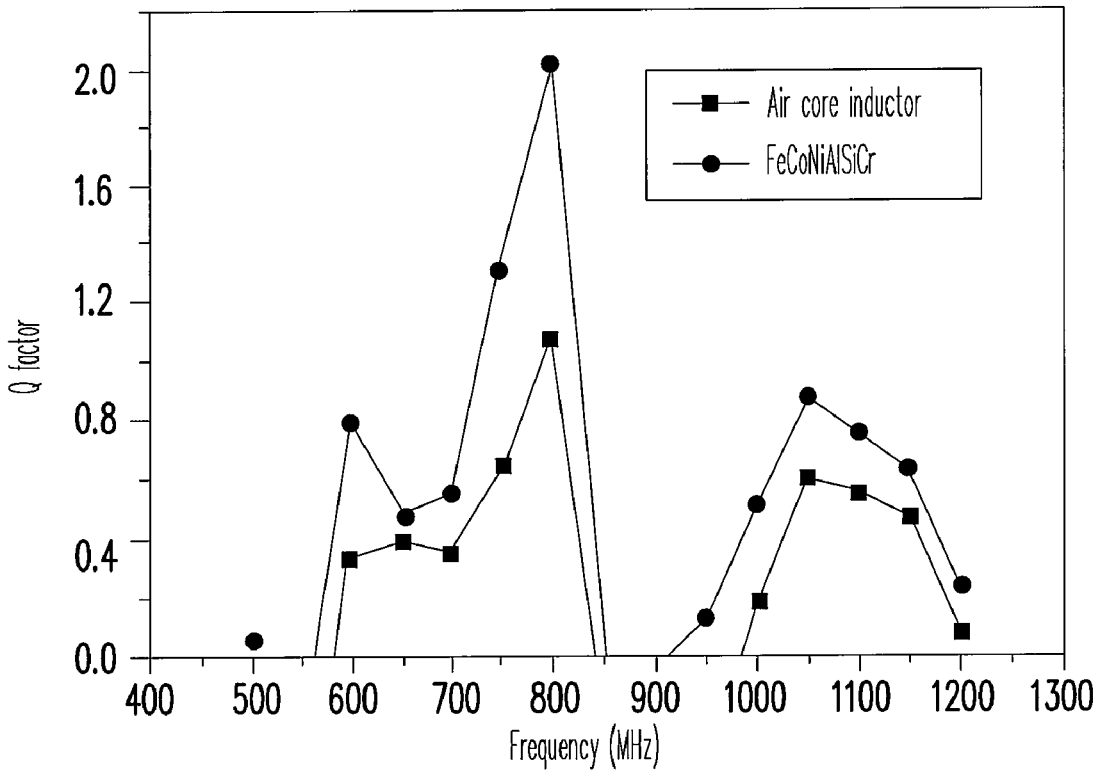
FIG. 7 is a diagram illustrating a comparison of a Q value of a FeCoNiAlCrSi soft magnetism thin film inductor with a frequency thereof.

After that, a FeCoNiAlCrSi thin film serving as the magnetic multi-element alloy film is adopted to fabricate the ferromagnetic thin film inductor on the condition that the annealing temperate is at 200° C. Except for the aforesaid conditions, the manufacturing process described in the experimental example 2 is similar to that indicated in the experimental example 1. Here, saturation magnetization of the FeCoNiAlCrSi thin film is 900 emu/cm$^3$, the coercive magnetic field in the hard-axis is 2 Oe, the magnetic anisotropy field intensity is about 20 Oe, and the thin film resistivity is 350 μΩ-cm. FIGS. 6 and 7 represent the inductance value and the Q value measured by a network analyzer. As shown in FIGS. 6 and 7, in the 800 MHz frequency band, the inductance value of the ferromagnetic thin film inductor using the FeCoNiAlCrSi thin film is increased by 14% in comparison with the air core inductor, and the Q value of the ferromagnetic thin film inductor using the FeCoNiAlCrSi thin film is increased by 90%. In other words, the inductor fabricated by using the magnetic multi-element high-entropy alloy film of the present invention again improves the inductance value and the Q value per unit surface area of the inductor.

EXPERIMENTAL EXAMPLE 3

Three alloy elements Fe, Co and B are selected and melted into the alloy target. The composition of the alloy target is $(Fe_{0.55}Co_{0.45})_{90}B_{10}$.

Next, a $(Fe_{0.55}Co_{0.45})_{90}B_{10}$ thin film is fabricated by performing the same manufacturing process as explained in experimental example 1, and various magnetic values are inspected. The data of the magnetic values are enumerated in Table 1.

EXPERIMENTAL EXAMPLES 4-8

Four alloy elements Fe, Co, B and M (M is selected from one of the following: Hf, Ta, Nb, Ti or V) are selected and melted into the alloy targets. The compositions of the alloy targets are stated hereinafter:

Experimental Example 4: $(Fe_{0.55}Co_{0.45})_{90}B_{7.5}Ti_{2.5}$

Experimental Example 5: $(Fe_{0.55}Co_{0.45})_{90}B_{7.5}Nb_{2.5}$

Experimental Example 6: $(Fe_{0.55}Co_{0.45})_{90}B_{7.5}V_{2.5}$

Experimental Example 7: $(Fe_{0.55}Co_{0.45})_{90}B_{7.5}Hf_{2.5}$

Experimental Example 8: $(Fe_{0.55}Co_{0.45})_{90}B_{7.5}Ta_{2.5}$

Next, a $(Fe_{0.55}Co_{0.45})_{90}B_{7.5}M_{7.5}$ thin film is fabricated by performing the same manufacturing process as explained in the experimental example 1, and the magnetic values are inspected. The data of the magnetic values are enumerated in Table 1.

EXPERIMENTAL EXAMPLE 9-11

Five alloy elements Fe, Co, B, Ti and Nb are selected and melted into the alloy target. The compositions of the alloy targets are provided hereinafter:

Experimental Example 9: $(Fe_{0.55}Co_{0.45})_{90}B_{2.5}Ti_5Nb_{2.5}$

Experimental Example 10: $(Fe_{0.55}Co_{0.45})_{90}B_5Ti_{2.5}Nb_{2.5}$

Experimental Example 11: $(Fe_{0.55}Co_{0.45})_{90}B_6Ti_2Nb_2$

Next, a $(Fe_{0.55}Co_{0.45})_{90}B_{2.5}Ti_5Nb_{2.5}$ thin film, a $(Fe_{0.55}Co_{0.45})_{90}B_5Ti_{2.5}Nb_{2.5}$ thin film, and a $(Fe_{0.55}Co_{0.45})_{90}B_6Ti_2Nb_2$ thin film are fabricated, and the magnetic values are inspected. The data of the magnetic values are enumerated in Table 1.

TABLE 1

| Experimental example | Saturation magnetization (emu/cm$^3$) | Coercive magnetic field in the easy-axis (Oe) | Coercive magnetic field in the hard-axis (Oe) | Magnetic anisotropy field intensity (Oe) | Thin film resistivity (μΩ-cm) | Resonant frequency* (GHz) |
|---|---|---|---|---|---|---|
| 3 | 16100 | 64.2 | 13.5 | 310 | 338 | ~6.3 |
| 4 | 17000 | 14.2 | 11.0 | 231 | 285 | ~5.6 |
| 5 | 15000 | 4.6 | 11.0 | 224 | 302 | ~5.1 |
| 6 | 16300 | 50.4 | 39.0 | 241 | 326 | ~5.5 |
| 7 | 15200 | 2.5 | 8.3 | 216 | 239 | ~5.1 |
| 8 | 17100 | 5.0 | 1.4 | 100 | 206 | ~3.7 |
| 9 | 15700 | 85.9 | 17.8 | 200 | 294 | ~5.0 |
| 10 | 16230 | 14.3 | 12.2 | 214 | 300 | ~5.2 |
| 11 | 15100 | 7.4 | 2.6 | 214 | 330 | ~5.0 |

*Calculated based on theory

It can be learned from Table 1 that in experimental examples 1~11, the thin film resistivity is larger than or equal to 200 μΩ-cm, the coercive magnetic fields in the easy-axis and in the hard-axis are both less than or equal to 100 Oe, and the magnetic anisotropy field intensity is larger than or equal to 20 Oe. The devices fabricated with use of the multi-element alloy film cannot achieve the high-frequency band on the conditions that the thin film resistivity of the multi-element alloy film is less than 200 μΩ-cm, the coercive magnetic fields in the easy-axis and in the hard-axis exceed 100 Oe, and the magnetic anisotropy field intensity is less than 20 Oe. Accordingly, it can be deduced from the results of the experimental examples 1~11 that the magnetic multi-element alloy film of the present invention still possesses favorable soft magnetism when operated in high frequency.

Moreover, according to the results shown in Table 1, the coercive magnetic field in the easy-axis in the experimental example 3 ($(Fe_{0.55}Co_{0.45})_{90}B_{10}$) is 64.2 Oe. As B is replaced with 2.5 at. % of a refractory element (referring to Ti in the experimental example 4, Nb in the experimental example 5, V in the experimental example 6, Hf in the experimental example 7, and Ta in the experimental example 8), and a $(Fe_{0.55}Co_{0.45})_{90}B_{7.5}M_{2.5}$ alloy film is then formed, the coercive magnetic fields in the easy-axis can be significantly reduced. Even though the metal M is selected from Nb (in the experimental example 5), Hf (in the experimental example 7) and Ta (in the experimental example 8), the coercive magnetic fields in the easy-axis are all approximately less than 5 Oe.

On the other hand, as the metal M is selected from Ti (in the experimental example 4) and Ta (in the experimental example 8), saturation magnetization thereof is increased from 16100 emu/cm$^3$ to 17000 emu/cm$^3$, approximately.

It is known from Table 1 that when a $(Fe_{0.55}Co_{0.45})_{90}B_{10}$ composition is given, and B is replaced with 2.5 at. % of Ti and 2.5 at. % of Nb (in the experimental example 9), 5.0 at. % of Ti and 2.5 at. % of Nb (in the experimental example 10), or 2.0 at. % of Ti and 2.0 at. % of Nb(in the experimental example 11), the composition of the alloy is $(Fe_{0.55}Co_{0.45})_{90}B_5Ti_{2.5}Nb_{2.5}$, $(Fe_{0.55}Co_{0.45})_{90}B_{2.5}$ Furthermore, when the resonant frequencies of the three multi-element alloy films are measured, respectively, it can be observed that the resonant frequencies thereof are all equal to or larger than 3 GHz.

In light of the foregoing, the magnetic multi-element alloy film of the present invention is characterized by high randomness, nanometer microcrystalline structure, low coercive magnetic field and high resistivity. Thus, the magnetic multi-element alloy film still has favorable soft magnetism when operated in high frequency. Moreover, since the magnetic multi-element alloy film can be formed by performing the sputtering process, the fabrication of the magnetic multi-element alloy film can be integrated into the standard VLSI manufacturing process.

In addition, the soft magnetism thin film inductor of the present invention has a greater inductor value and a better Q factor than the air core inductor does when operated in high frequency. Besides, the manufacturing process of the soft magnetism thin film inductor according to the present invention is rather simple, reducing time and manufacturing costs.

Although the present invention has been disclosed above by the embodiments, they are not intended to limit the present invention. Anybody skilled in the art can make some modifications and alteration without departing from the spirit and scope of the present invention. Therefore, the protecting range of the present invention falls in the appended claims.

What is claimed is:

1. A soft magnetism thin film inductor, comprising:

a first dielectric layer;

a spiral conductive layer disposed on the first dielectric layer, wherein a starting point of the spiral conductive layer is in a center of the spiral, and a destination point of the spiral conductive layer is in outermost peripheral areas of the spiral;

a second dielectric layer disposed on the spiral conductive layer; and a magnetic multi-element alloy film disposed on the second dielectric layer, wherein the magnetic multi-element alloy film is composed of 3~13 types of elements, wherein a general formula of a composition of the magnetic multi-element alloy film is AXM, A is selected from one or more groups consisting of Fe, Co and Ni, X is selected from one or more groups consisting of Si and B, M is selected from one or more groups consisting of Hf, Cu, Al, Ta, Nb, Cr, Sn, Zr, Ti, Pd, Au, Pt, Ag, Ru, Mo, V and Mn, the magnetic multi-element alloy film doesn't include O, N and rare earth element, and A accounts for 70~90 at. % of all atomic elements.

2. The soft magnetism thin film inductor as claimed in claim 1, wherein a thickness of the magnetic multi-element alloy film ranges from 50 nm to 2000 nm.

3. The soft magnetism thin film inductor as claimed in claim 1, wherein A is Fe and Co.

4. The soft magnetism thin film inductor as claimed in claim 3, wherein X is B, and M is selected from one or more groups consisting of Hf, Cu, Al, Ta, Nb, Cr, Sn, Zr, Ti, Pd, Au, Pt, Ag, Ru, Mo, V and Mn, and M accounts for 1~9 at. % of all the atomic elements.

5. The soft magnetism thin film inductor as claimed in claim 4, wherein M is selected from one or more groups consisting of Hf, Ta, Nb, Ti and V.

6. The soft magnetism thin film inductor as claimed in claim 4, wherein M is Nb and Ti.

7. The soft magnetism thin film inductor as claimed in claim 4, wherein M is selected from one of the groups consisting of Hf, Ta, Nb, Ti and V.

8. The soft magnetism thin film inductor as claimed in claim 1, wherein A is Fe, Co and Ni.

9. The soft magnetism thin film inductor as claimed in claim 8, wherein X is B, and M is Al.

10. The soft magnetism thin film inductor as claimed in claim 8, wherein X is Si, and M is Al and Cr.

11. The soft magnetism thin film inductor as claimed in claim 1, wherein a material of the first dielectric layer comprises oxide, nitride or fluoride.

12. The soft magnetism thin film inductor as claimed in claim 1, wherein a material of the second dielectric layer comprises oxide, nitride or fluoride.

13. The soft magnetism thin film inductor as claimed in claim 1, wherein a material of the spiral conductive layer comprises Al or Cu.

14. A magnetic multi-element alloy film, wherein a general formula of a composition of the magnetic multi-element alloy film is AXM, A is selected from one or more groups consisting of Fe, Co and Ni, X is selected from one or more groups consisting of Si and B, M is selected from one or more groups consisting of Hf, Cu, Al, Ta, Nb, Cr, Sn, Zr, Ti, Pd, Au, Pt, Ag, Ru, Mo, V and Mn, A accounts for 70~90 at.% of all atomic elements, AXM is composed of 3~3 types of elements, and the magnetic multi-element alloy film doesn't include O, N and rare earth element.

15. The magnetic multi-element alloy film as claimed in claim 14, wherein a thickness of the magnetic multi-element alloy film ranges from 50 nm to 2000 nm.

16. The magnetic multi-element alloy film as claimed in claim 14, wherein A is Fe and Co.

17. The magnetic multi-element alloy film as claimed in claim 16, wherein X is B, and M is selected from one or more groups consisting of Hf, Cu, Al, Ta, Nb, Cr, Sn, Zr, Ti, Pd, Au, Pt, Ag, Ru, Mo, V and Mn, and M accounts for 1~9 at.% of all the atomic elements.

18. The magnetic multi-element alloy film as claimed in claim 17, wherein M is selected from one or more groups consisting of Hf, Ta, Nb, Ti and V.

19. The magnetic multi-element alloy film as claimed in claim 17, wherein M is Nb and Ti.

20. The magnetic multi-element alloy film as claimed in claim 17, wherein M is selected from one of the groups consisting of Hf, Ta, Nb, Ti and V.

21. The magnetic multi-element alloy film as claimed in claim 14, wherein A is Fe, Co and Ni.

22. The magnetic multi-element alloy film as claimed in claim 21, wherein X is B, and M is Al.

23. The magnetic multi-element alloy film as claimed in claim 21, wherein X is Si, and M is Al and Cr.

* * * * *